US008464405B2

(12) United States Patent
Takeuchi

(10) Patent No.: US 8,464,405 B2
(45) Date of Patent: Jun. 18, 2013

(54) JEWELRY CLASP

(75) Inventor: Yukiko Takeuchi, Shinjuku-Ku (JP)

(73) Assignee: Kabushiki Kaisha Mikimoto, Chuo-Ku (JP)

( * ) Notice: Subject to any disclaimer, the term of this patent is extended or adjusted under 35 U.S.C. 154(b) by 34 days.

(21) Appl. No.: 13/059,421

(22) PCT Filed: Jan. 29, 2010

(86) PCT No.: PCT/JP2010/051254

§ 371 (c)(1),
(2), (4) Date: Feb. 17, 2011

(87) PCT Pub. No.: WO2011/092846

PCT Pub. Date: Aug. 4, 2011

(65) Prior Publication Data

US 2011/0239414 A1 Oct. 6, 2011

(51) Int. Cl.
*A44C 25/00* (2006.01)

(52) U.S. Cl.
USPC ..... 24/518; 24/116 A; 24/584.1; 63/3.1

(58) Field of Classification Search
USPC ..... 24/116 A, 518, 584.1, 587.11, 586.11; 63/3.1, 3.2
See application file for complete search history.

(56) References Cited

U.S. PATENT DOCUMENTS

| | | | | |
|---|---|---|---|---|
| 3,181,217 | A * | 5/1965 | Bohlinger et al. | 24/116 A |
| 4,530,221 | A * | 7/1985 | Weinberg | 63/3.2 |
| 5,018,250 | A * | 5/1991 | Schroder | 24/116 A |
| 2009/0301134 | A1 * | 12/2009 | Kim-Araneo | 63/3.1 |

FOREIGN PATENT DOCUMENTS

| | | |
|---|---|---|
| CN | 2479775 | 3/2002 |
| JP | 60-207606 A1 | 10/1985 |
| JP | 09-299117 A1 | 11/1997 |

OTHER PUBLICATIONS

Chinese Office Action mailed Feb. 28, 2012 (with English Translation).

* cited by examiner

*Primary Examiner* — Robert J Sandy
*Assistant Examiner* — Michael Lee
(74) *Attorney, Agent, or Firm* — Burr & Brown

(57) ABSTRACT

A clasp according to an embodiment of the invention has a first annular body and a second annular body, the first annular body extending along an outer surface on one side of a semispherical portion of the spherical jewelry product, and the second annular body extending along an outer surface on the other side of the semispherical portion of the spherical jewelry product. In the case where two adjacent clasps are used so as to form a pair and in the case where the pair of clasps are closed, the shape of the proximal end of each of the first and second annular bodies is configured such that the proximal end in one clasp extends so as to pass through the inside of the other clasp and such that the proximal end in the other clasp extends so as to pass through the inside of one clasp.

5 Claims, 7 Drawing Sheets

JEWELRY CLASP

BACKGROUND OF THE INVENTION

1. Field of the Invention

The present invention relates to a jewelry clasp and especially relates to a technique that improves aesthetic appearance and convenience for users as a result of, for example, two clasps which are individually provided at the two ends of a pearl necklace being capable of employing a state in which the clasps individually embrace pearls and being capable of employing a state in which the clasps engage with each other.

2. Description of the Related Art

A typical example of a pearl necklace includes one of a type having clasps (clamps) at the two ends thereof, the clasps being able to individually embrace pearls.

In this type of pearl necklace, one clasp embraces any one of pearls that are arranged in series in the form of a string, and the other clasp embraces any one of the other pearls, so that the length of the pearl necklace is capable of being adjusted or so that the appearance of the necklace is capable of being changed when the necklace is worn [for example, see Japanese Unexamined Utility Model Application Publication No. 4-40484 (FIGS. 7 to 9 thereof)].

Furthermore, in some types of clasp that embraces the pearl, two clasps are used and then are connected to each other, so that the shape of a pearl necklace that is worn around a neck is capable of being variously changed (for example, see Japanese Unexamined Patent Application Publication Nos. 63-10736 and 2007-275398).

However, in the technique disclosed in Japanese Unexamined Utility Model Application Publication No. 4-40484 (FIGS. 7 to 9 thereof), the two clasps that are individually provided at the two ends of a pearl necklace are not capable of being connected to each other.

Accordingly, in the case where a pearl necklace is set so as to have the greatest length, the pearls of the necklace extend in the form of double lines as illustrated in disclosed FIG. 9, the pearls being arranged in series between the two clasps in the form of a string. Therefore, aesthetic appearance is not capable of being improved.

In addition, in the techniques disclosed in Japanese Unexamined Patent Application Publication Nos. 63-10736 and 2007-275398, the two clasps are connected to each other by using a retaining ring. Therefore, aesthetic appearance is poor, and furthermore the retaining ring is not easily removed and attached, resulting in decreased convenience for users.

SUMMARY OF THE INVENTION

Accordingly, in order to overcome the above disadvantages of the typical techniques, it is an object of the present invention to provide a jewelry clasp, which is capable of employing a state in which a spherical jewelry product is embraced and is capable of employing a state in which one clasp engages with another adjacent clasp, thereby providing excellent aesthetic appearance and increased convenience for users.

According to an aspect of the invention, there is provided a jewelry clasp that is capable of embracing a spherical jewelry product, the clasp including: a first annular body and a second annular body, the first annular body extending along an outer surface on one side of a semispherical portion of the jewelry product when the jewelry product is embraced, and the second annular body extending along an outer surface on the other side of the semispherical portion of the jewelry product when the jewelry product is embraced; a shaft that connects proximal ends of the first and second annular bodies to each other such that the first and second annular bodies are capable of swinging relative to each other between a closed state in which the jewelry product is embraced and an opened state in which the jewelry product is capable of being removed; and a locking section that releaseably locks swinging ends of the first and second annular bodies together in the case where the first and second annular bodies are in the closed state. In the case where two adjacent clasps are used so as to form a pair and in the case where the pair of clasps are closed, the shape of the proximal end of each of the first and second annular bodies is configured such that the proximal end in one clasp is capable of extending so as to pass through the inside of the other clasp and such that the proximal end in the other clasp is capable of extending so as to pass through the inside of one clasp.

Namely, for example, the jewelry clasp according to an aspect of the invention is capable of being used so as to form a pair, and the pair of clasps are capable of being separately provided at the two ends of a pearl necklace.

By virtue of this configuration, one clasp embraces any one of pearls that are arranged in series in the form of a string, and the other clasp embraces any one of the other pearls. Therefore, the length of a pearl necklace is capable of being adjusted, or the pearls are capable of being arranged in the form of double lines between the two clasps, the pearls extending in series in the form of a string.

Furthermore, in the jewelry clasp according to an aspect of the invention, in the case where the two clasps are used, the two clasps are capable of engaging with each other without using a retaining ring, thereby being connected to each other.

Accordingly, the two clasps that are connected to each other form a novel design, and excellent aesthetic appearance is provided. Furthermore, users are capable of easily combining and removing the two clasps, so that increased convenience is provided.

Furthermore, each of the first and second annular bodies may have the proximal end that linearly extends so as to have a narrow width and may have an intermediate portion and the swinging end, the intermediate portion and the swinging end extending so as to form a rounded shape.

Furthermore, in the case where each of the first and second annular bodies opens on a plane, each of the first and second annular bodies may exhibit a droplet-like shape.

Moreover, at least any one of the first and second annular bodies has a connector to which an end of a line of the jewelry products is connected, the jewelry products extending in the form of a string.

DETAIED DESCRIPTION OF THE INVENTION

Figure 1:
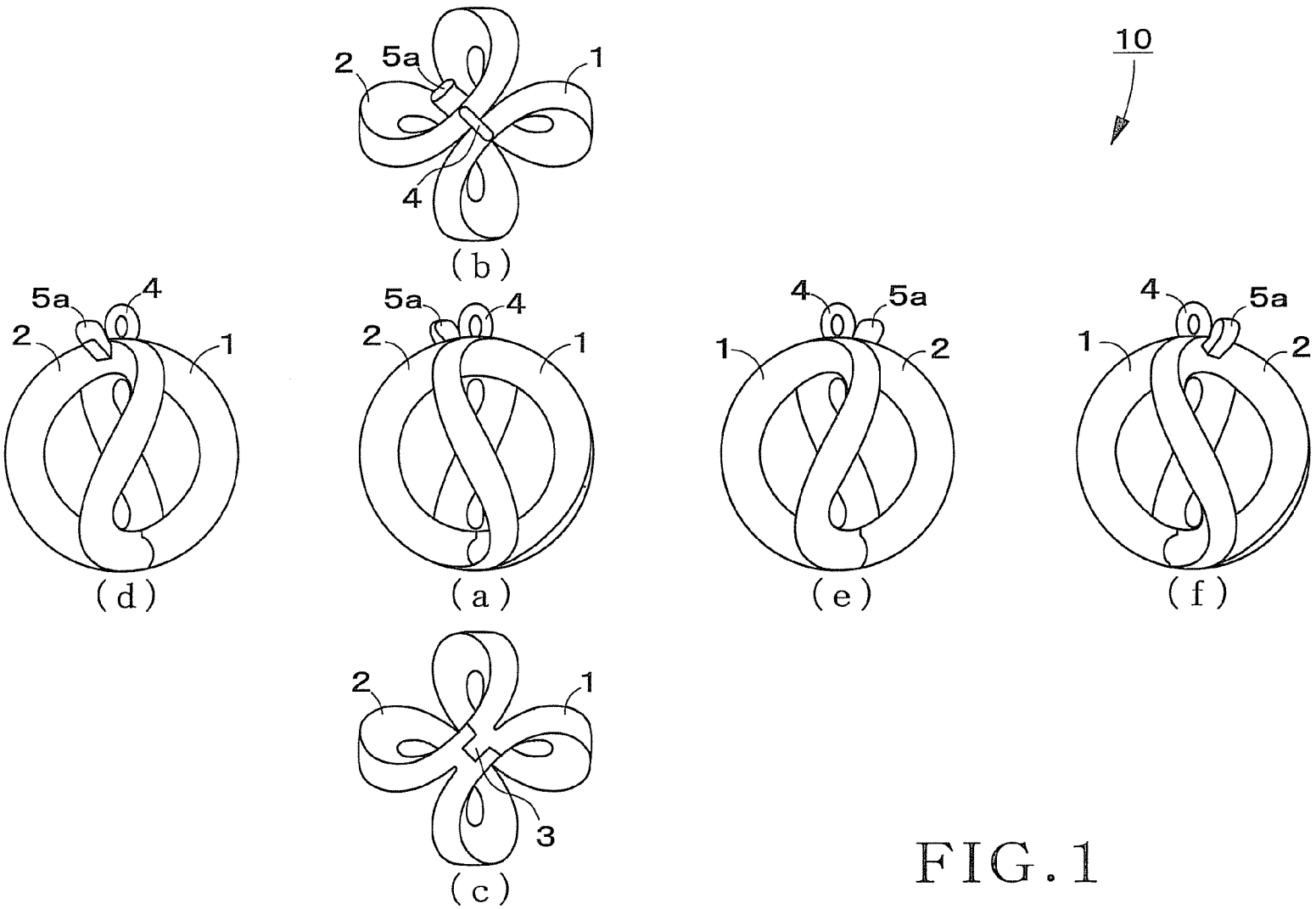
FIG. 1A illustrates a jewelry clasp according to an embodiment of the invention.
FIG. 1B illustrates the jewelry clasp according to the embodiment of the invention.
FIG. 1C illustrates the jewelry clasp according to the embodiment of the invention.
FIG. 1D illustrates the jewelry clasp according to the embodiment of the invention.
FIG. 1E illustrates the jewelry clasp according to the embodiment of the invention.
FIG. 1F illustrates the jewelry clasp according to the embodiment of the invention.
Figure 2:
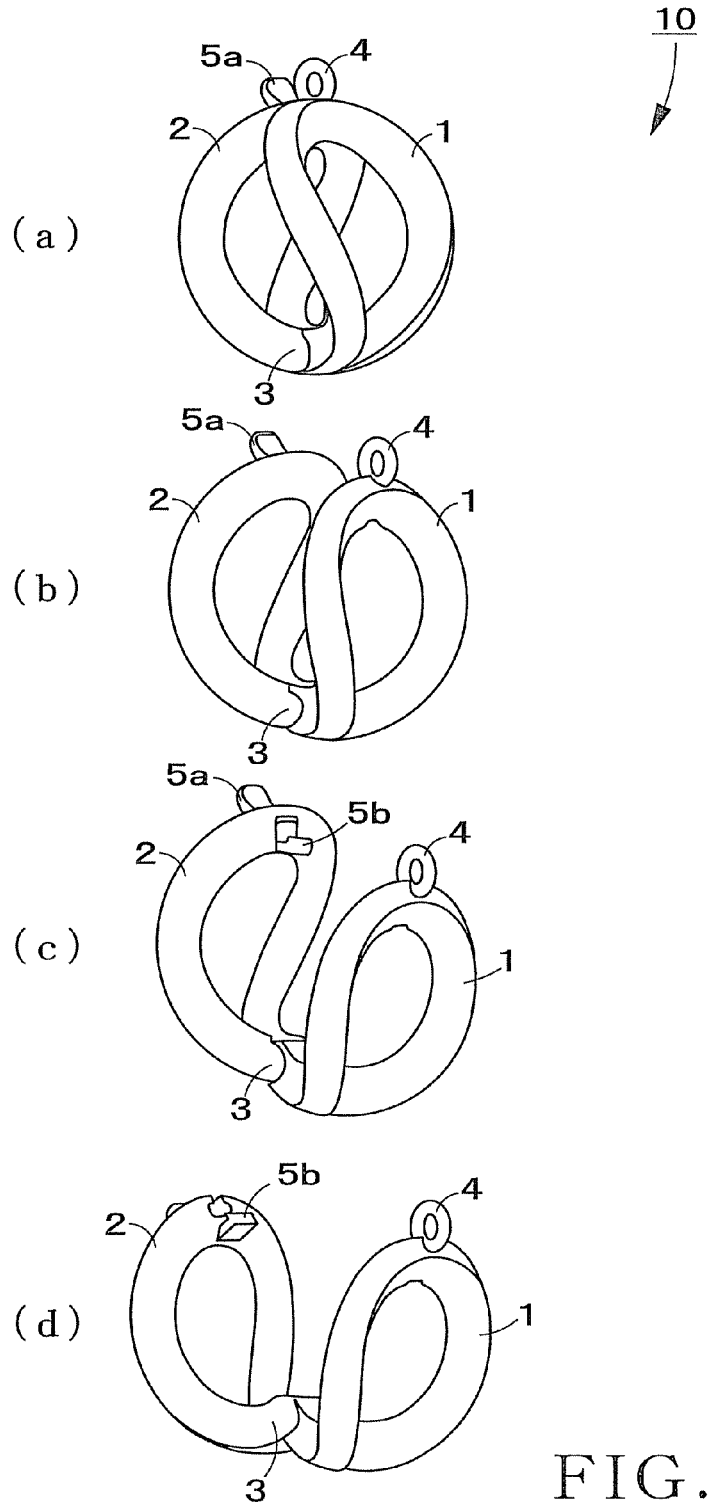
FIG. 2A illustrates the opening and closing operation of the clasp in FIG. 1.
FIG. 2B illustrates the opening and closing operation of the clasp in FIG. 1.
FIG. 2C illustrates the opening and closing operation of the clasp in FIG. 1.
FIG. 2D illustrates the opening and closing operation of the clasp in FIG. 1.

A clasp according to an embodiment of the invention will be hereinafter described in detail with reference to FIGS. 1 to 8.

As illustrated in FIGS. 1A to 4, a clasp 10 of the embodiment includes a first annular body 1 and a second annular body 2 which are connected to each other through a shaft 3*a* of a hinge 3 so as to be able to swing relative to each other.

A ring 4 is provided at a swinging end of the first annular body 1 and is capable of being connected to an end of pearls S by using a clamp (not illustrated) as illustrated in FIGS. 5 to 8, the pearls S extending in series in the form of a string.

A locking section 5 is formed on the first and second annular bodies 1 and 2. The locking section 5 enables the first and second annular bodies 1 and 2 to be connected to each other in a locking manner, thereby being able to hold the clasp 10 in a closed state.

Figure 4:
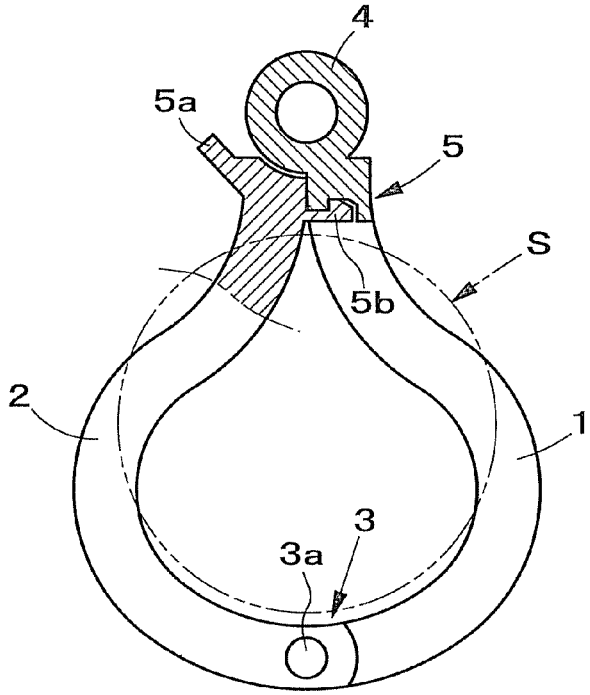
FIG. 4 is a cross-sectional side view partially illustrating the clasp in FIG. 1.

With reference to FIG. 4, the locking section 5 has an outward protrusion 5*a*, an inward protrusion 5*b*, and a hollow portion 1*d*, the outward protrusion 5*a* and the inward protrusion 5*b* being provided at a swinging end of the second annular body 2, and the hollow portion 1*d* being formed in an inner peripheral surface of the first annular body 1.

Accordingly, the swinging end of the second annular body 2 is pressed against the swinging end of the first annular body 1, and then the inward protrusion 5*b* intrudes into the hollow portion 1*d*. Therefore, the clasp 10 is held in a closed state.

In contrast, users push the outward protrusion 5*a* to the outside with the fingers of one hand while the ring 4 is held with the fingers of the other hand, and then the clasp 10 is capable of being in an opened state.

Figure 3:
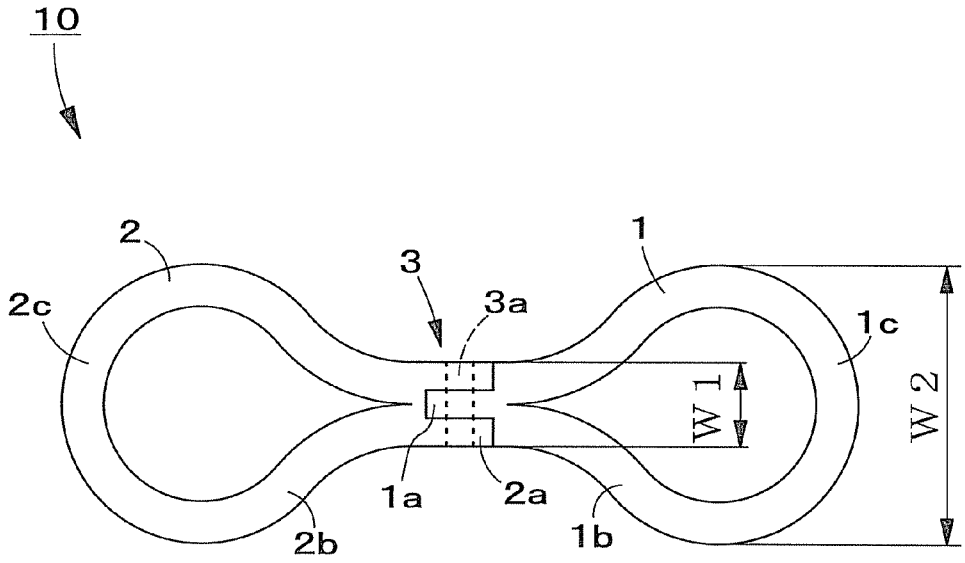
FIG. 3 illustrates the clasp in FIG. 1 in a state in which the clasp is opened onto a plane.

Meanwhile, with reference to FIG. 3, in the case where the first and second annular bodies 1 and 2 are opened onto a plane, each of the first and second annular bodies 1 and 2 exhibits a teardrop-like shape, not a precise circle.

More specifically, respective proximal ends 1*a* and 2*a* of the first and second annular bodies 1 and 2 linearly extend such that the total width of the proximal ends 1*a* and 2*a* is narrowed to a width W1.

On the other hand, in the first and second annular bodies 1 and 2, intermediate portions 1*b* and 2*b* and swinging ends 1*c* and 2*c* extend so as to form substantially rounded shapes, respectively. The entire width of each of the substantially rounded shapes expands to a width W2.

Figure 5:
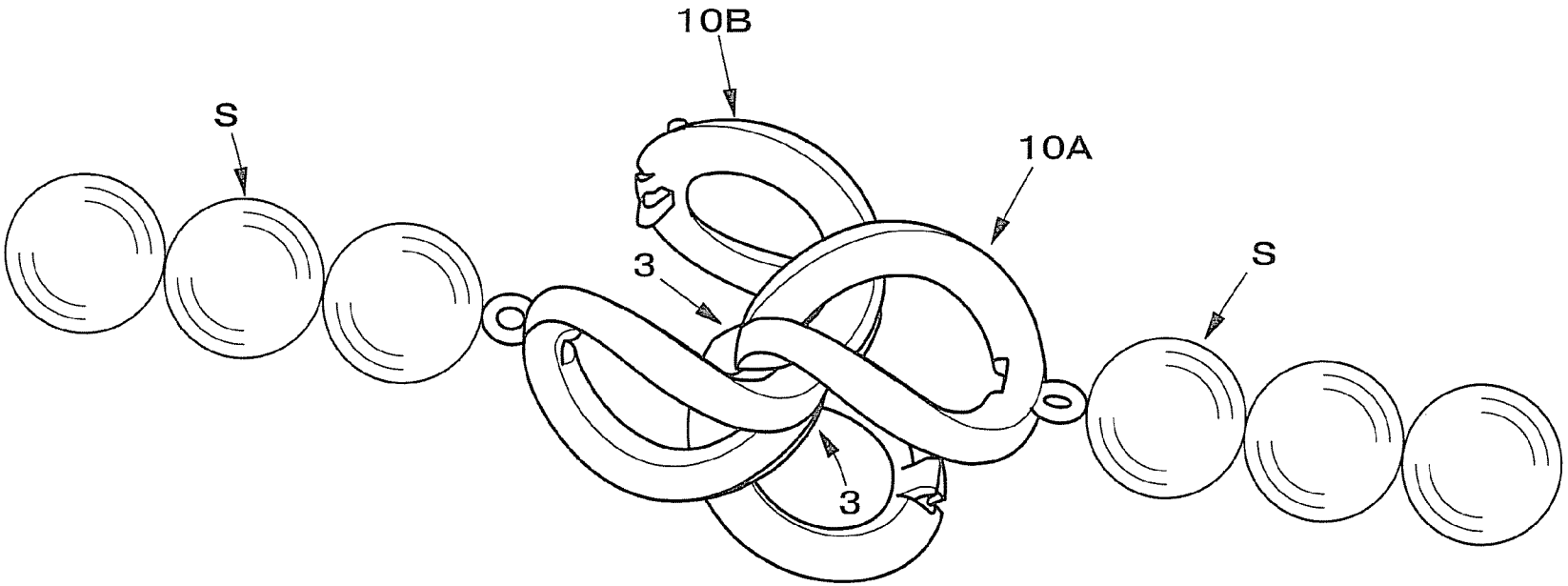
FIG. 5 illustrates states in which the clasps in FIG. 1 are used and in which the clasps are opened to be combined with each other.

Accordingly, with reference to FIG. 5, in the case where the clasps 10 of the embodiment are used so as to form a pair, a pair of clasps 10A and 10B that are in the opened state are capable of approaching each other such that one of the proximal ends of the clasps 10A and 10B is displaced with respect to the other at a relative angle of 90°.

Figure 6:
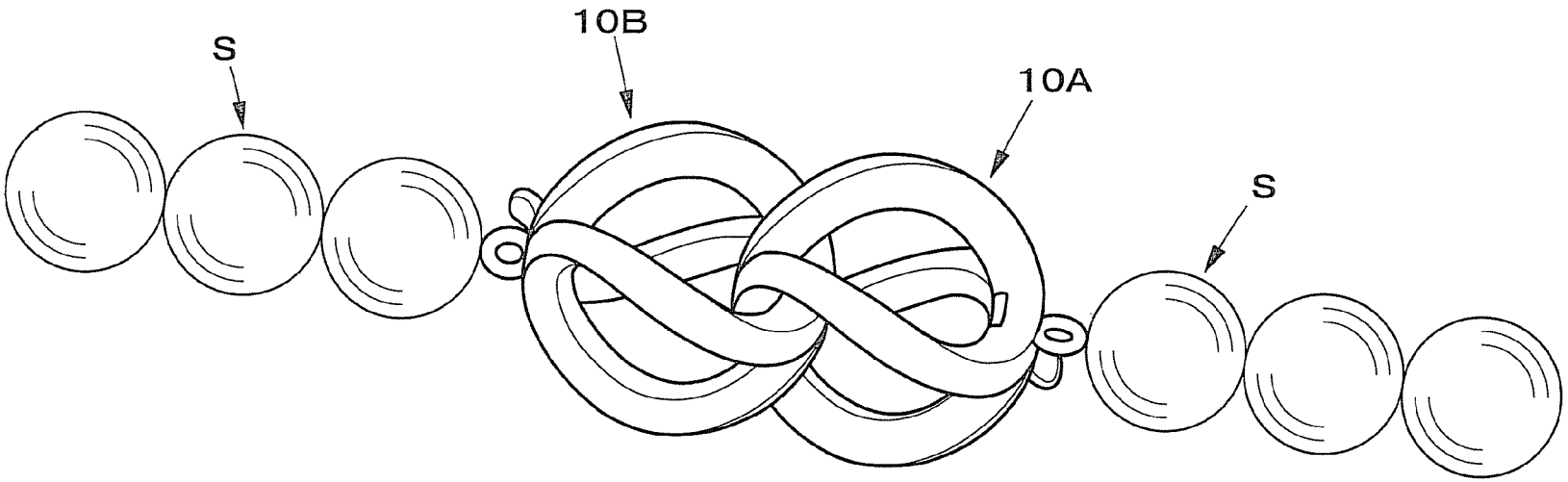
FIG. 6 illustrates a state in which the clasps in FIG. 1 close in order to be connected to each other.

Then, with reference to FIG. 6, in the case where the pair of the clasps 10A and 10B are in the closed state, the clasps 10A and 10B are capable of being combined with each other such that the proximal end of the clasp 10A extends so as to pass through the inside of the clasp 10B and such that the proximal end of the clasp 10B extends so as to pass through the inside of the clasp 10A.

Namely, the clasp 10 of the embodiment provides an advantageous configuration, in which the two clasps 10A and 10B that are individually fixed to the two ends of the pearls S are capable of being combined so as to be connected to each other, the pearls S extending in series in the form of a string.

In the two clasps 10A and 10B that are combined with each other, a total of four annular bodies 1 and 2 are set so as to entwine each other as illustrated in FIG. 6 with the result that a complex appearance is exhibited, the four annular bodies 1 and 2 extending in a curved manner.

Therefore, unlike the case in which two clasps are connected to each other by using a retaining ring as disclosed in Japanese Unexamined Patent Application Publication Nos. 63-10736 and 2007-275398, the clasp 10 of the embodiment is capable of significantly improving aesthetic appearance.

Especially, the first and second annular bodies 1 and 2 are colored platinum, silver, or gold so as to match the color of the pearls S, so that a novel accessory having an excellent luxury appearance is capable of being provided, the pearls S extending in series in the form of a string.

Figure 7:
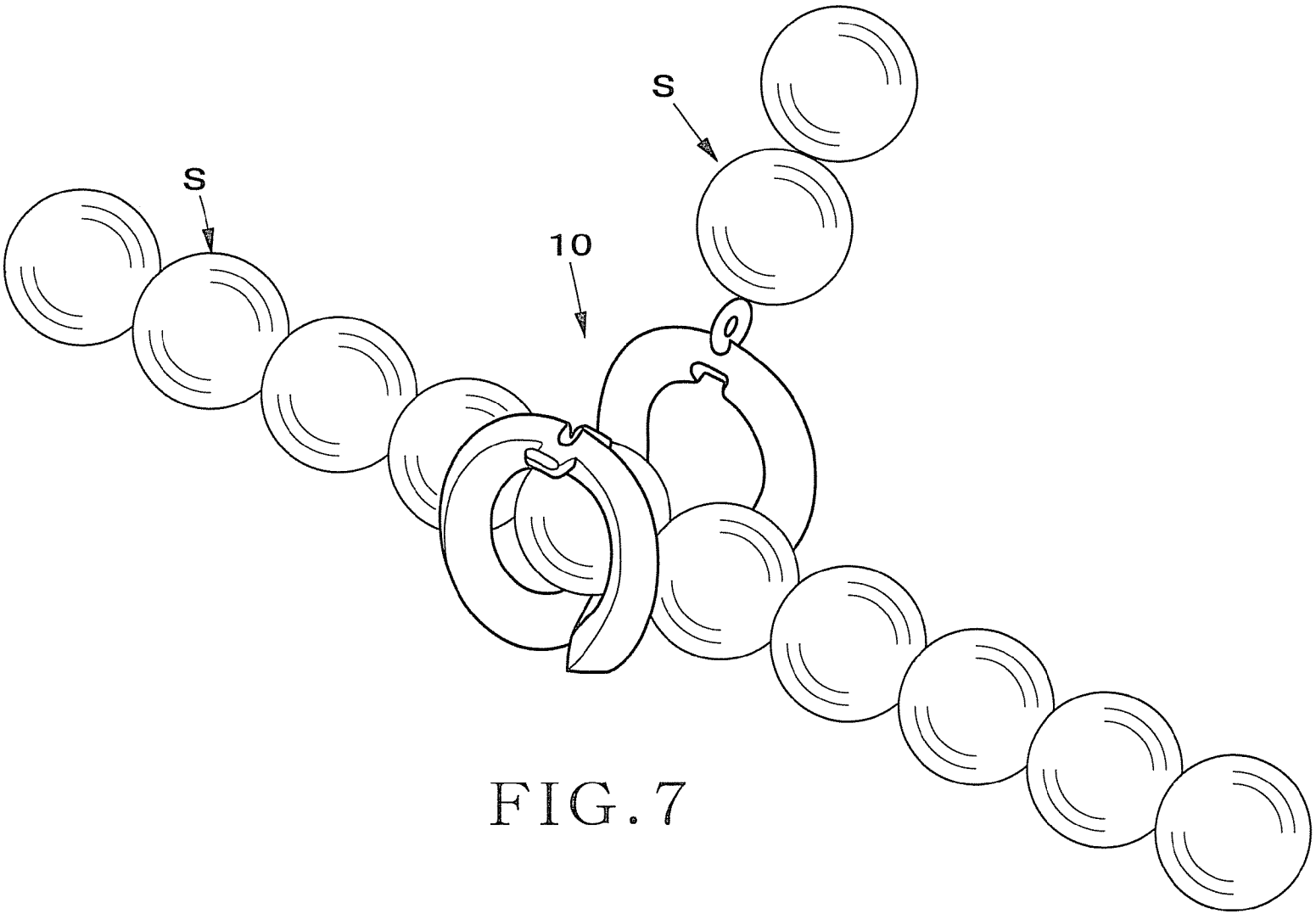
FIG. 7 illustrates a state in which the clasp in FIG. 1 opens to receive a pearl.
Figure 8:
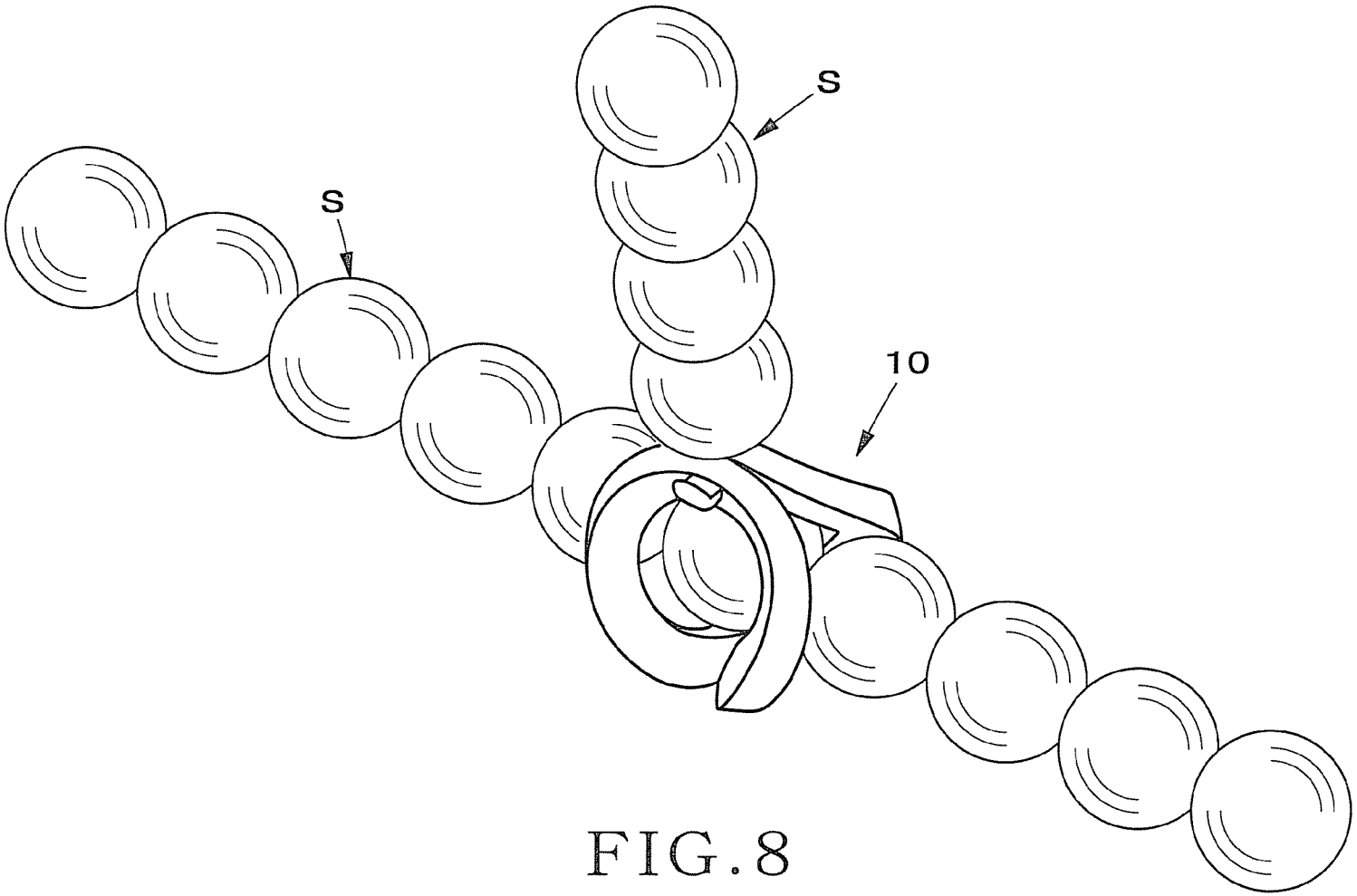
FIG. 8 illustrates a state in which the clasp in FIG. 1 closes to embrace a pearl.

Furthermore, with reference to FIGS. 7 and 8, the clasp 10 of the embodiment is capable of embracing one pearl among the pearls S of a pearl necklace.

Accordingly, the clasp 10A that is fixed to one end embraces any one of the pearls that are arranged in series in the form of a string, and the clasp 10B that is fixed to the other end embraces any one of the other pearls, so that the length of the pearl necklace is capable of being adjusted and so that the pearls are capable of extending in the form of double lines, the pearls extending in series between the two clasps 10A and 10B in the form of a string.

Furthermore, as illustrated in FIG. 8, in the case where the clasp 10 of the embodiment embraces the pearl S, the first annular body 1 extends along an outer surface on one side of a semispherical portion of the pearl S in a curved manner, and the second annular body 2 extends along an outer surface on the other side of the semispherical portion of the pearl S in a curved manner.

Accordingly, the spherical pearl S and the two annular bodies 1 and 2 are disposed as if entwined with one another, so that aesthetic appearance is capable of being significantly improved in contrast with the typical clasp used for a pearl necklace.

Although the jewelry clasp according to the embodiment of the invention has been described in detail, embodiments of the invention are not limited to the above embodiments. Obviously, the above embodiments may be variously modified.

For example, in the above embodiment, in the case where the first and second annular bodies 1 and 2 are opened onto a plane, each of the first and second annular bodies 1 and 2 included in the clasp 10 exhibits a teardrop-like shape as illustrated in FIG. 3.

However, the shape of each of the first and second annular bodies 1 and 2 may be changed as long as the two clasps 10A and 10B are capable of being combined so as to be connected to each other.

What is claimed is:

1. A jewelry clasp comprising a plurality of clasp each capable of embracing a spherical jewelry product, each clasp comprising:

a first annular body and a second annular body, the first annular body capable of being disposed on or above an outer surface of a semispherical portion of one side of the spherical jewelry product when the spherical jewelry product is embraced, and the second annular body capable of being disposed on or above an outer surface of the semispherical portion of the other side of the spherical jewelry product when the spherical jewelry product is embraced;

a shaft connecting proximal ends of the first and second annular bodies to each other so that the first and second annular bodies swing relative to each other between a closed state in which the spherical jewelry product is embraced and an opened state in which the spherical jewelry product can be removed; and a locking section that releaseably locks swinging ends of the first and second annular bodies together when the first and second annular bodies are in the closed state;

wherein when two adjacent clasps form a pair and when the pair of clasps are closed, a shape of the proximal ends of each of the first and second annular bodies is configured so that a proximal end of one clasp extends to pass through an inside of the other clasp and so that a proximal end of the other clasp extends to pass through the inside of the one clasp.

2. The jewelry clasp according to claim 1, wherein the proximal ends of each of the first and second annular bodies extend linearly to have a narrow width; and wherein each of the first and second annular bodies has an intermediate portion that extends from the swinging end to define a rounded shape.

3. The jewelry clasp according to claim 2, wherein when each of the first and second annular bodies are opened onto a plane, each of the first and second annular bodies define a droplet-like shape.

4. The jewelry clasp according to claim 1, wherein any one of the first and second annular bodies has a connector to which an end of a line of the spherical jewelry products is connected, so that the spherical jewelry products extend thereform as string.

5. A jewelry clasp that is capable of embracing a spherical jewelry product, the clasp comprising:

a first annular body and a second annular body, the first annular body capable of being disposed on or above an outer surface of a semispherical portion of one side of the spherical jewelry product when the spherical jewelry product is embraced, and the second annular body capable of being disposed on or above an outer surface of another semispherical portion on the other side of the spherical jewelry product when the spherical jewelry product is embraced;

a shaft connecting proximal ends of the first and second annular bodies to each other so that the first and second annular bodies swing relative to each other between a closed state in which the spherical jewelry product is embraced and an opened state in which the spherical jewelry product can be removed; and a locking section that releaseably locks swinging ends of the first and second annular bodies together when the first and second annular bodies are in the closed state.

* * * * *